United States Patent [19]

Zechnall et al.

[11] Patent Number: 4,932,383

[45] Date of Patent: Jun. 12, 1990

[54] METHOD AND APPARATUS FOR CONTROLLING THE LAMBDA VALUE OF THE AIR/FUEL MIXTURE SUPPLIED TO AN INTERNAL COMBUSTION ENGINE

[75] Inventors: Martin Zechnall, Schwieberdingen; Albrecht Clement, Kornwestheim, both of Fed. Rep. of Germany

[73] Assignee: Robert Bosch GmbH, Stuttgart, Fed. Rep. of Germany

[21] Appl. No.: 325,148

[22] Filed: Mar. 17, 1989

[30] Foreign Application Priority Data

Apr. 20, 1988 [DE] Fed. Rep. of Germany ..... 3813219

[51] Int. Cl.[5] ..... F02D 41/14

[52] U.S. Cl. ..... 123/489

[58] Field of Search ..... 123/440, 489

[56] References Cited

U.S. PATENT DOCUMENTS 4,210,106 7/1980 Wessel et al. ..... 123/489

4,528,957 7/1985 Jundt et al. ..... 123/440

4,625,698 12/1986 Jamrog ..... 123/440

*Primary Examiner*—Tony M. Argenbright

*Attorney, Agent, or Firm*—Walter Ottesen

[57] ABSTRACT

The invention is directed to a method for controlling the lambda value of the air/fuel mixture supplied to an internal combustion engine. The method utilizes the signal of a lambda probe as the measurement of an actual value with this actual value displaying discontinuities during the transistion from the rich to the lean lambda region. The switch-over of the control direction in the direction "rich" is undertaken when the actual value in the form of the probe voltage passes through the reference voltage; however, this only happens when the probe voltage had an previously climbed to a threshold value "rich". Correspondingly, the control direction is swiched over to the direction "lean" only when the reference value is passed through and when the probe voltage previously had dropped to a threshold voltage "lean". The apparatus which operates pursuant to the method no longer leads to undefined control oscillations when cylinder scatter effects occur.

5 Claims, 2 Drawing Sheets

METHOD AND APPARATUS FOR CONTROLLING THE LAMBDA VALUE OF THE AIR/FUEL MIXTURE SUPPLIED TO AN INTERNAL COMBUSTION ENGINE

FIELD OF THE INVENTION

The invention relates to a method and an apparatus for controlling the lambda value of the air/fuel mixture supplied to an internal combustion engine. The method is performed with the aid of a lambda probe for making actual value measurements during which the actual value displays a discontinuous behavior during the transition from the rich to the lean lambda range and vice versa. The invention also relates to an apparatus for carrying out the method.

BACKGROUND OF THE INVENTION

The state of the art is discussed in the following with respect to FIGS. 1*a* and 1*b* of the drawing.

In the area concerning the invention, two-level control processes having a PI-characteristic are generally utilized with the control factor FR being supplied as an actuating variable with which a precontrol value is multiplied for the actuating signal of a fuel-metering arrangement. As a rule, the fuel-metering arrangement is an injection-valve arrangement and the precontrol values are preliminary injection time durations. The lambda value is used as a control value whose actual value is determined in the exhaust gas of the engine by means of a lambda probe displaying the performance referred to above. The lambda actual value measured at a predetermined point in time is assigned to a fuel injection quantity which was adjusted at a point in time which is earlier by a dead time T. This adjustment of the fuel quantity is made by means of the control method. Because of this dead time T, a control oscillation of the control factor FR is introduced which is illustrated in FIG. 1*a*.

FIG. 1*a* also shows another measure which is often used, namely, the P-component (proportional component) is greater in the direction of making the mixture rich than in the direction of making the latter lean. This serves to make the adjustment of the mean lambda value somewhat smaller (richer) than unity (1) in order to attain the optimal operating point of the three-way catalyzer which is conventionally used. In this respect, reference may be made to U.S. Pat. No. 4,210,106 which is incorporated herein by reference.

It is known that the probe voltage US oscillates at times with a higher frequency about a reference voltage UREF than can be derived from the control oscillation period. This oscillation of a higher frequency occurs, for example, because of scattering in the air number of different volumes of air or different combustions. Such effects are often included under the common term of "chemical noise". It should be noted that the effects are especially pronounced in certain speed and load ranges which are dependent upon the engine.

In the diagram of FIG. 1*a*, it is assumed that the control factor FR will vary with an amplitude of approximately 4% deviation from its average mean value lying just below unity (1) because of fluctuations in the actual value of lambda caused by the normal control oscillations. It is further assumed that dynamic effects lead to a lambda value fluctuation of approximately 1%. This means that when the multiplication factor FR is just in the range between approximately 0.99 and 1.01 during its control oscillations, the influence of the dynamic effects on the lambda-value measurement can outweigh the influence of the control oscillations so that this can therefore lead to an oscillation of the probe voltage US with increased frequency.

The time range within which the control factor FR passes through the range between 1.01 and 0.99 for a correct oscillatory performance of the control unit is indicated in FIG. 1*a* by reference designation TI. It is assumed that in the second control pulse in FIG. 1*a*, a the second half of dynamic performance of the lambda value occurs, for example, because the rotational speed has entered into a critical range thereof. The dynamic performance of the lambda value at the air-intake end of the engine during the time duration TI is delayed at the lambda probe by a dead time T as shown all the way to the right in FIG. 1b. Here it can be seen how the probe voltage US oscillates about the reference voltage UREF at a relatively high frequency. With each pass-through of the probe voltage through the value of the reference voltage UREF, this oscillation leads to a change in the operating direction of the control process as shown all the way to the right in FIG. 1*a*. The continuous alternations lead to a rapid increase of the control factor FR in the direction "rich" because, as explained above, the P-component in the direction "rich" is greater than the P-component in the direction "lean".

The last-mentioned rapid increase of the control factor FR is prevented in the lambda control device MOTRONIC (trademark of Robert Bosch GmbH) in that the time duration between two pass-throughs of the probe voltage US through the reference voltage UREF is controlled. As soon as this time duration drops below a threshold such as the speed-dependent dead time T, the assumption is made that the above-mentioned dynamic effects become effective. The P-component is then set for both control directions to that value which applies during proper operation only to the direction "rich". In this way, the control factor FR no longer changes rapidly in one direction; however, an uncontrollable drift of this factor does occur since the reference voltage is not passed through because of the I-component (integral-action component) in the control factor; instead, this reference voltage UREF is passed through because of the P-component thereof.

SUMMARY OF THE INVENTION

It is an object of the invention to provide a method for controlling the lambda value of the air/fuel mixture supplied to an internal combustion engine which operates without drift even in the case where cylinder scatter effects are present. It is another object of the invention to provide an apparatus for carrying out the method of the invention.

Every cylinder of an internal combustion engine should ideally make the same contribution. However, a scattered performance results with respect to the cylinders for several reasons which include, for example, variations in cylinder dimensions within tolerance ranges occurring during manufacturing, aging variations of ancillary components such as the injection valves and dirtying of spark plugs in the case of gasoline engines. These effects taken together are known as cylinder scatter effects.

The method of the invention is characterized in that it does not reverse the control direction with each pass-through of the probe voltage US through the reference voltage UREF as is the case in known methods; instead, this reversal occurs only when a threshold voltage "rich" or "lean" has been exceeded. The invention utilizes the discovery that the oscillations of the probe voltage US caused by cylinder scatter have a lesser amplitude and a shorter period duration than those oscillations which occur during the control in a control segment with dead time during use of a two-level controller having a PI-characteristic.

The method of the invention takes note of the pass-through of the probe voltage US through one of the two above-mentioned threshold voltages, for example, the threshold voltage "rich". If the probe voltage again moves toward the reference voltage UREF and passes through the latter, then the control direction is reversed as in the previous methods. However, at the same time, the means is reset which noticed the pass-through through the threshold voltage. This has the consequence that the control direction is no longer continuously reversed when the probe voltage subsequently oscillates about the reference voltage without having first reached one of the threshold voltages. Only when this condition has first been satisfied, that is, for example if the threshold voltage "lean" has been reached and then the reference voltage has again been reached, the control direction is again reversed.

The arrival at one of the threshold voltages thereby effects an activation for the reversal of the control direction; however, this does not trigger such a reversal. The triggering occurs only after the reference voltage is reached when previously the activation took place. In order to practice the method of the invention, a suitable apparatus includes means for activating the control in the direction "lean", means for triggering the control in the direction "lean"; means for activating the control in the direction "rich"; and, means for triggering the control in the direction "rich". These means can be made up of conventional components such as comparators, flip-flops and logic components; however, and pursuant to present day technology, they are formed as parts of a program, such as by means of flags which are set and reset with the occurrence of the above-mentioned conditions. The different means can be different states of such a flag, for example, the means for triggering the control in the direction "lean" can be the set condition of a flag, and in contrast, the means for triggering the control in the direction "rich" can correspond to the reset condition of the same flag.

According to a preferred embodiment of the invention, the control direction can also be then determined when the probe voltage, starting from the reference voltage, reaches one of the threshold voltages. This determination is then without significance if the control direction occurs with a first pass-through of the reference voltage after a previously completed pass-through of one of the threshold voltages.

This further embodiment of the invention becomes effective when the lambda value no longer fluctuates between "rich" and "lean", for example because of a change of the operating state (under some circumstances with superposed cylinder scatter); instead, when, starting out from the condition "rich" for example, only the reference voltage is reached and not the threshold voltage "lean" but then the threshold voltage "rich" is reached again. In this special case, and for the basic embodiment of the method of the invention, the control direction is not reversed again in the direction of making the mixture lean. In correspondence with the special case just mentioned above, the further embodiment even in the special case of starting the method becomes effective in a positive manner when this starting is initiated by unforeseen conditions. In each case it is then assured that a control in the direction of "lean" occurs when the threshold voltage "rich" is exceeded and a control in the direction "rich" takes place when there is a drop beneath the threshold voltage "lean".

In order to have as few defective operations of the method as possible, it is advantageous to place the threshold voltages "rich" and "lean" as far away as possible from the reference voltage and close to the rich-level or the lean-level of the probe voltage; that is, at those values of the probe voltage which are reached during the presence of normal control oscillations without cylinder scatter. This condition can however not be maintained when the probe voltage is determined with such an averaging time that it cannot reach the threshold voltages during higher frequency oscillations such as are caused by cylinder scattering. In this case, those voltages can be used as threshold voltages as are used to detect probe readiness as described in U.S. Pat. No. 4,528,957 incorporated herein by reference.

BRIEF DESCRIPTION OF THE DRAWINGS

The invention will now be described with reference to FIGS. 2 and 3 described below. The FIGS. 1*a* and 1*b* were referred to above as an aid in describing the state of the art. All of the figures are described below wherein.

Description of the Preferred Embodiments of the Invention

Before describing the flow diagram of FIG. 2, the coordinates of the diagrams of FIGS. 3*a* and 3*b* will be explained in greater detail.

Figure 1A:
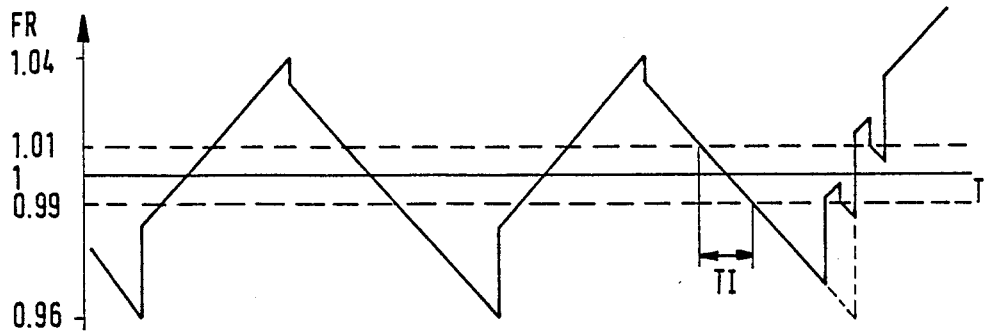
FIGS. 1*a* and 1*b* are time-synchronized diagrams showing the control factor FR and the probe voltage US as functions of time for conventional methods.
Figure 1B:
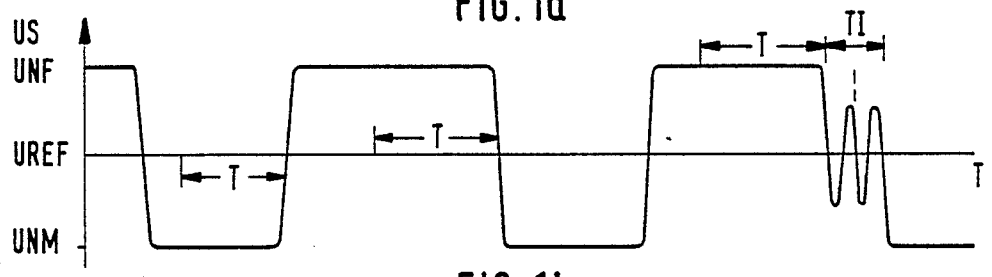
Figure 3A:
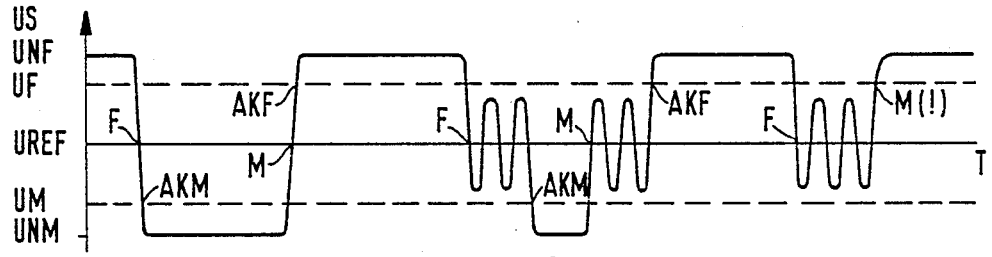

In FIG. 3*a*, the course of the probe voltage US of a lambda probe measuring actual values is shown as a function of time. Five different voltage levels are indicated, namely, the rich level UNF, the threshold voltage "rich" UF, the reference voltage UREF, the threshold voltage "lean" UM and the lean level UNM. The significance of the level voltages was already explained above. The rich level voltage UNF amounts to, for example, approximately 900 mV and the lean level voltage is approximately 50 mV. The threshold voltage UF is, for example, approximately 800 mV, the reference voltage UREF is approximately 500 mV and the threshold voltage UM lies at approximately 150 mV. In lieu of voltages, lambda values could be indicated; however, it is more conventional to use the voltages measured by a lambda probe directly for control without first converting into the lambda value corresponding thereto.

Figure 3B:
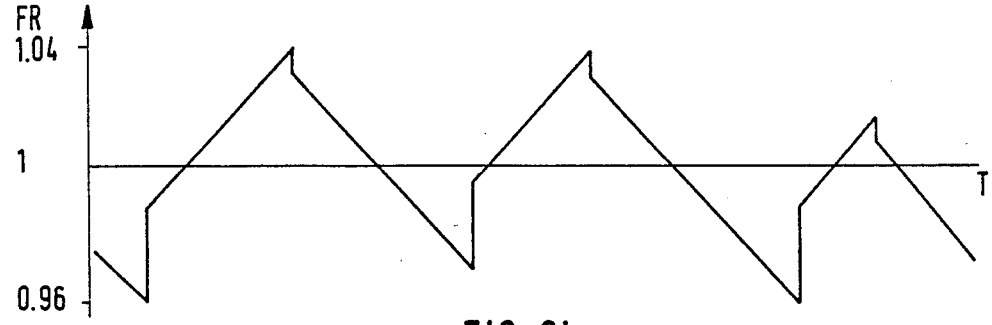

In FIG. 3*b*, the value of the control factor FR is shown as a function of time. This factor fluctuates about the mean value 1. Values above 1 mean a lengthening of the injection time, that is, enriching the air/fuel mixture; whereas, values below 1 mean making this mixture leaner. By correlating FIGS. 3*a* and 3*b*, it can be seen that the control factor FR assures an enrichment when the probe voltage indicates a lean mixture and vice versa.

Figure 2:
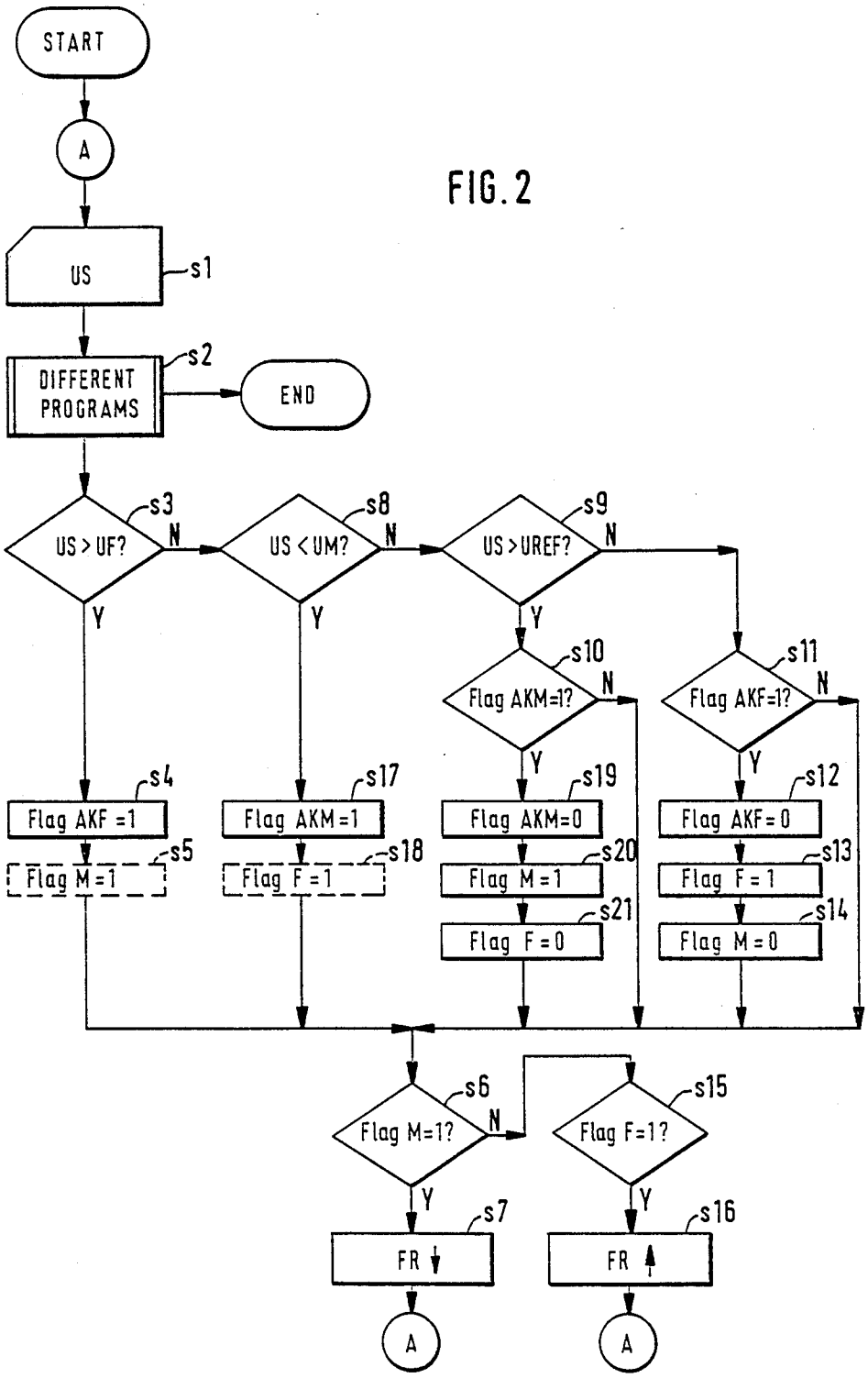
FIG. 2 is a flow diagram for explaining an embodiment of the method and apparatus of the invention wherein the threshold voltages operate to activate the control direction; and, FIGS. 3*a* and 3*b* are time-synchronized diagrams showing the instantaneous course of the probe voltage US and control factor FR as functions of time for a method and apparatus according to the invention which operate pursuant to the flow diagram shown in FIG. 2.

In the flow diagram of FIG. 2, a marking "A" is reached first after the start of the process. The program loop described below returns to this location each time after it has been processed which can be recognized in that the flow diagram at its end likewise terminates with the marking "A". In the first method step s1 of the loop, the value of the probe voltage US which is present at that particular instant, is read. Thereafter, a number of subprograms is processed and these subprograms are taken together in a single process step s2. In these subprograms, a check for example is made to determine if the lambda probe is operationally ready after a cold start and if the subsequent control program can already be carried out. If this is not the case, a return directly to marking "A" is made. The entire program runout can however also be interrupted, for example, when it is determined that the probe is not functioning properly or that special conditions are present such as overrun or that the fuel mixture is being enriched for acceleration. However, if it is determined that the probe is functioning correctly and is warm so as to be operationally ready and no special conditions are present, then the actual control process begins with a step s3.

In step s3, a check is made to determine if the probe voltage US is greater than the threshold voltage UF. It is assumed that the system oscillates just in that condition shown all the way to the right in FIG. 3*a*. The above-mentioned condition is then fulfilled. In step s4, a flag AKF is then set which activates a control in the direction "rich"; however, this control is not yet triggered.

In an advantageous embodiment, a step s5 follows after the above-mentioned step s4 and this step s5 is shown in FIG. 2 in phantom outline and will be explained further below. Without this advantageous step s5, the process advances to a step s6 wherein a check is made to determine if a flag M is set which, for the set condition, shows that a control in the direction "lean" should be made. It is assumed, that the flag M is actually set in an initialization process. This measure is reasonable since the probe usually indicates a rich mixture when it reaches its operational ready condition, that is, a value which perforce requires a leaning of the mixture. As mentioned, and because the flag M is set, the control factor FR is reduced in the following step s7, that is, the mixture is made still more lean. Thereafter, the process returns to the marking "A".

Now assuming that when carrying out step s1, the probe voltage US had already dropped below the threshold voltage UF but that it is still higher than the reference voltage UREF. The step s2 will be run through again unimpeded which also applies to the runouts to be described further below and it is for this reason that this step is not mentioned again.

In step s3, it is now determined that the probe voltage US is no longer greater than the threshold voltage UF. In the step s8 following this negative response, a check is made to determine if the probe voltage US is less than the threshold voltage UM. Even this is not the case. A step s9 then follows wherein a check is made to determine if the probe voltage US is greater than the reference voltage UREF. This is the case and a step s10 follows wherein a check is made if a flag AKM is set which indicates that there is a drop beneath the threshold voltage UM. The flag AKM is set in the initialization process to the value 0 for a rich mixture because of the signal which is first present as described above. According to the flow diagram, this has the consequence that the steps s6 and s7 mentioned above follow directly after the step s10, that is, the mixture continues to be made more lean in an unchanging manner. The process returns again to the marking "A".

Assume now that the probe voltage US read in in step s1 is less than the reference voltage UREF. This has the consequence that in the decision step s9, the response is now "n" whereupon step s11 follows wherein a check is made to determine if the flag AKF is set. This is the case which, according to the flow diagram, initiates a step s12 wherein the flag is reset. In the following steps s13 and s14, a flag F is set and the flag M is reset. The flag F indicates that the mixture is to be enriched, that is, the control factor FR should be increased. The interrogation of flag M follows in the already mentioned step s6 and this interrogation is to be responded to with "n" because of the reset which had just occurred. Step s15 follows wherein a check is made to determine if flag F is set. Since this is the case, the control factor FR is increased in a step s16, that is, the mixture is enriched. The process then returns to the marking "A".

In the next read-in step s1, the probe voltage US has dropped below the value of the threshold voltage UM. The interrogation in step s8 is now to be responded to with "j". As a consequence thereof, a flag AKM is set in step s17. The set flag AKM indicates that the control direction "lean" is activated. In a further advantageous embodiment indicated above, a step s18 follows which will be further explained below. Without this step s18, the known step s6 for checking the flag M follows directly after the step s17. Since the flag M is not set, the steps s15 and s16 follow unchanged as described in the paragraph above, that is, the mixture is further enriched. Thereafter, the process returns to the marking "A".

For the process runout to be considered next, the probe voltage US again has a value greater than the threshold UM; however, the probe voltage US has not yet reached the reference voltage UREF again. The process then runs to the step s9 and there establishes that the probe voltage still lies beneath the reference voltage and so responds to the interrogation of step s9 with "n". In step s11, a check is made to determine if the flag AKF is set. Since the flag AKF had been reset in step s12, the interrogation is to be answered with "n" which has as a consequence the runout of steps s6, s15 and s16 in an unchanged manner with this runout being described in the last two previous paragraphs. Accordingly, the mixture continues to be enriched and the process returns to the marking "A".

In the next reading of the probe voltage US in step s1, this voltage can be greater than the reference voltage UREF. The response in step s9 is therefore "j" and the step s10 of checking the flag AKM follows Since this flag AKM had been set in step s17, the interrogation is now responded to with "j". The flag AKM is reset as a consequence thereof in a following step s19 and in subsequent steps s20 and s21, the flag M is set and the flag F is reset. In the step s6 which then follows and in a manner determined at the very beginning of the runout described, the flag M is set which has the result that with the step s7, the control factor FR is reduced and thereby the mixture is made more lean. The process returns to the marking "A".

If the probe voltage US is again greater than the threshold voltage UF in the next process runout, then the runouts repeat as described above.

From the foregoing, it is apparent that the flag M is set in step s20 only when the condition is fulfilled of a set flag AKM in the previous step s10. Correspondingly, the flag F is only set in step s13 when the condition of a set flag AKF is fulfilled in step s11. This and the function of step s9 show that the control direction is only changed if the reference voltage is exceeded and the flag corresponding to a new control direction has been previously activated. With the first increase above the reference voltage, the corresponding flag is reset and only when the particular threshold voltage (by means of which the flag was set) is again reached, the flag is reset. This results in the fact that oscillations of the probe voltage about the reference voltage UREF, as shown in the center and to the right in FIG. 3*a*, do not effect a continuous switching of the control direction. With the basic principle described, the problem present in the state of the art of an undefined control behavior is avoided when higher frequency oscillations of the probe voltage occur because of cylinder scatter. With the basic embodiment of the process, difficulties are however encountered when the probe voltage US does not run through the two threshold voltages UF and UM in an alternate manner and instead, after dropping from the threshold voltage UF, for example, the threshold voltage UM is no longer reached and instead the probe voltage US again increases above the threshold voltage UF as shown all the way to the right in FIG. 3*a*. This does not result in the embodiment shown in a change of the ongoing enrichment of the mixture to making the mixture more lean since the flag AKM for activating the control in the direction "lean" could not yet be set. Accordingly, the mixture continues to be enriched until an error of the control is discovered in a subprogram in step s2 and the method is restarted with the step for making the mixture more lean.

According to another advantageous embodiment of the method described above, the steps s5 and s18 already mentioned above are available to assure a rapid control performance in the special case just described above. In step s5, the flag M is set and in step s18, the flag F is set. This means that if the threshold voltage UF is exceeded, then the mixture is made more lean for every case, and then, when there is a drop below the threshold voltage UM, the mixture is made more rich in every case. The flag M and the flag F are not only set with the first pass-through of the reference voltage UREF after a previously completed pass-through through a threshold voltage; instead, the flags M and F are also set during a pass-through through a threshold voltage itself. If these flags have already been set because of the condition mentioned above, then the renewed setting is without influence. However, if the case mentioned in the previous paragraph and shown all the way to the right in FIG. 3*a* occurs, then the setting occurs only with a pass-through of the threshold voltage. The above-mentioned measure has also the effect that the method operates even after a cold start always in the direction toward the desired lambda value independently of any initialization conditions.

As mentioned above, the flag AKM constitutes a means for activating the control in the direction "lean", the flag M constitutes means for triggering the control in the direction "lean", the flag AKF constitutes a means for activating the control in the direction "rich" and the flag F constitutes a means for triggering the control in the direction "rich". The desired operations occur in each instance with the set condition of the flag. It can now be seen however that the flag M is always set when the flag F is reset and vice versa. The two different conditions of a flag can be utilized as a means for triggering the control in the direction "lean" or "rich". Correspondingly, the illustrated method runout can be so modified that the flag AKF is always set when the flag AKM is reset and vice versa. Then the means for activating the control in the direction of "lean" or "rich" can likewise be realized by the two different conditions of an individual flag. The above-mentioned means can however also be discrete components such as flip-flops.

In the above embodiment, the premise was taken that the probe voltage US was used in the same form in all three comparison steps s3, s8 and s9. However, the probe voltage US can, for example, be used directly to make a comparison with the reference voltage UREF in step s9 and, in contrast, the probe voltage US can be used in averaged form to make a comparison with the threshold voltages in steps s3 and s8. This measure has the advantage that even for low speeds and simultaneous use of a lambda probe of low inertia, it is assured that the averaged probe voltage remains in amplitude significantly below the rich level UNF or the lean level UNM during its oscillations because of cylinder scatter effects; that is, the probe voltage remains below those amplitudes which are reached during control operations without cylinder scatter effects. The averaging time is so dimensioned that the probe voltage during cylinder scatter time intervals does not reach the threshold voltages even under unfavorable conditions.

The additional averaging is not required if an adequately sluggish lambda probe is used or it is unnoticeable in the range of lower speeds when cylinder scatter effects lead to drifting control oscillations. In a further embodiment, it is possible to use the averaged probe signal also in step s9 of the comparison with the reference voltage UREF. This is the case because the oscillating times during cylinder scatter durations are shorter than the times of control oscillations without cylinder scatter, for example, only one tenth to one fifth of the above-mentioned times.

For explaining the function of the method and apparatus of the invention, the premise was taken that the cylinder scatter effects lead to a scatter of approximately 1% in the lambda value referred to the different cylinders. However, the spread of the scatter is very greatly dependent upon the configuration of the internal combustion engine and the particular speed. For especially critical speeds, the scatter can be significantly above 1%. In the method and apparatus according to the invention, this leads to increased control oscillations; however, it does not lead to continuous switchover of the control direction and the uncontrollable drift of the actuating variable which is connected therewith.

In the embodiment of the invention, the premise was taken that the threshold voltages UF and UM were fixed. However, it is also possible that the threshold voltages or other threshold values such as the lambda threshold value can be stored in a threshold value computer and be addressable via values of operating variables. For high speeds, lower threshold values can be used than at lower speeds because of the fixed signal processing inertias. This assures that the threshold values are sufficiently far from the rich level UNF or from the lean level UNM so that these threshold values can be attained even under unfavorable operating conditions when control oscillations without superposed cylinder scatter effects are present.

It is understood that the foregoing description is that of the preferred embodiments of the invention and that various changes and modifications may be made thereto without departing from the spirit and scope of the invention as defined in the appended claims.

What is claimed is:

1. Method of controlling the lambda value of the air/fuel mixture supplied to an internal combustion engine having a control system for generating a control actuating variable for controlling the condition of said mixture, the method comprising the steps of:

measuring an actual value (US) with a lambda probe for which the actual value (US) displays discontinuities when passing from the rich to the lean lambda region;

providing a rich (UF) threshold level and a lean (UM) threshold level;

detecting when said actual value (US) passes through said threshold levels; and, providing a reference value (UREF);

switching the control system to move in the rich direction by increasing the value of said control actuating variable when said actual value (US) passes through said reference value provided that said actual value (US) had previously climbed to said rich (UF) threshold value; and, switching the control system to move in the lean direction by decreasing the value of said control actuating variable when said actual value (US) passes through said reference value (UREF) provided that said actual value (US) had previously dropped to said lean (UM) threshold value.

2. The method of claim 1, wherein said switch-over of said control direction also occurs when said actual value passes through one of said two threshold values in the event said switch-over has not already been carried out and in the direction lean when said actual value climbs at least to said rich (UF) threshold value and in the direction rich when said actual value drops at least to said lean (UM) threshold value.

3. The method of claim 2, wherein said threshold values lie as far as possible from said reference value.

4. The method of claim 2, wherein said actual value is averaged with such a time constant that the averaged value does not reach said threshold values when said actual value oscillates rapidly between high and low values and instead reaches these values when the value changes are essentially conditioned only by actuating value changes.

5. Apparatus for controlling the lambda value of the air/fuel mixture supplied to an internal combustion engine having a control system for generating a control actuating variable for controlling the condition of said mixture and having a lambda probe for measuring the actual value (US) with said actual value (US) displaying discontinuities when passing from the rich to the lean lambda region and vice versa, the apparatus comprising:

first activating means (flag AKM) for activating the control in a first direction for making said mixture lean;

first triggering means (flag M) for triggering the control in the first direction to make the mixture lean;

second activating means (flag AKF) for activating the control in a second direction to make the mixture rich;

second triggering means (flag F) for triggering the control in the second direction to make the mixture rich;

means for setting said first activating means in said first direction when said actual value reaches a threshold value corresponding to a lean condition and resetting said first activating means when said first triggering means is set in said first direction;

means for setting said first triggering means in said first direction when said first activating means is set in said first direction and when said actual value (US) passes through a reference value (UREF);

means for setting said second activating means in said second direction when said actual value (US) reaches a threshold value corresponding to a rich condition and resetting said second activating means when said second triggering means is set in said second direction; and, means for setting said second triggering means in said second direction when said second activating means is set in said second direction and said actual value (US) passes through said reference value (UREF).

* * * * *

UNITED STATES PATENT AND TRADEMARK OFFICE

CERTIFICATE OF CORRECTION

PATENT NO. : 4,932,383

DATED : June 12, 1990

INVENTOR(S) : Martin Zechnall and Albrecht Clement

It is certified that error appears in the above-identified patent and that said Letters Patent is hereby corrected as shown below:

In the Abstract, line 12: delete "an".

In the Abstract, line 14: delete "swiched" and substitute -- switched -- therefor.

In column 2, line 10: between "second" and "control" please insert -- half of the second --.

In column 2, line 11: delete "the second half of".

In column 6, line 60: delete "follows" and substitute -- follows. -- therefor.

Signed and Sealed this

Tenth Day of March, 1992

*Attest:*

*Attesting Officer*

HARRY F. MANBECK, JR.

*Commissioner of Patents and Trademarks*